US011691840B2

(12) United States Patent
Seniff

(10) Patent No.: US 11,691,840 B2
(45) Date of Patent: Jul. 4, 2023

(54) OVERLAY SHEET TENSIONER APPARATUS

(71) Applicant: GERBER TECHNOLOGY LLC, Tolland, CT (US)

(72) Inventor: Dana Wade Seniff, South Glastonbury, CT (US)

(73) Assignee: GERBER TECHNOLOGY LLC, Tolland, CT (US)

( * ) Notice: Subject to any disclaimer, the term of this patent is extended or adjusted under 35 U.S.C. 154(b) by 137 days.

(21) Appl. No.: 17/212,626

(22) Filed: Mar. 25, 2021

(65) Prior Publication Data

US 2021/0300709 A1 Sep. 30, 2021

Related U.S. Application Data

(60) Provisional application No. 63/000,118, filed on Mar. 26, 2020.

(51) Int. Cl.
*B65H 5/06* (2006.01)
*B65H 23/182* (2006.01)
*B65H 35/00* (2006.01)

(52) U.S. Cl.
CPC ..... *B65H 23/1825* (2013.01); *B65H 35/0073* (2013.01)

(58) Field of Classification Search
CPC ..... B65H 23/1825; B65H 23/1888; B65H 35/0073; B65H 35/02; B65H 35/04; B65H 35/06; B65H 5/06; B26F 1/3813
See application file for complete search history.

(56) References Cited

U.S. PATENT DOCUMENTS 3,495,492 A * 2/1970 Gerber ..... D06H 7/02 83/427
3,742,802 A 7/1973 Maerz
3,777,604 A 12/1973 Gerber
4,434,691 A * 3/1984 LeBlond ..... B26D 7/018 83/56
7,284,305 B1 * 10/2007 Allen ..... B26D 7/14 26/7
2001/0037709 A1 11/2001 Kuchta et al.

FOREIGN PATENT DOCUMENTS

EP 1045746 A 10/2000
EP 1790443 A 5/2007

OTHER PUBLICATIONS

International Search Report and Written Opinion issued in corresponding international patent application No. PCT/US2021/024192, dated Jun. 14, 2021, 14 pages.

* cited by examiner

*Primary Examiner* — Sang K Kim
(74) *Attorney, Agent, or Firm* — Day Pitney LLP; George N. Chaolas

(57) ABSTRACT

An apparatus is provided for handling overlay sheet material on a cutting apparatus including a conveyor for moving work material in a longitudinal direction and a support for positioning a tensioner frame adjacent the conveyor. A tensioner frame, attached to the support, has a nip wheel and a drive for rotating the nip wheel with a tangential speed in excess of the longitudinal conveyor speed attached to the tensioner frame. The nip wheel engages the overlay sheet material applying a tension thereto in the same longitudinal direction as the conveyor.

19 Claims, 7 Drawing Sheets

OVERLAY SHEET TENSIONER APPARATUS

CROSS REFERENCE TO RELATED APPLICATION

The present application claims the benefit and priority of U.S. Provisional Application Ser. No. 63/000,118, dated Mar. 26, 2020, the contents of which are incorporated herein by reference in their entirety for all purposes whatsoever.

BACKGROUND OF THE DISCLOSURE

1. Field of the Disclosure

This disclosure relates in general to automatic cutting machines for flexible materials and, more particularly, relates to automatic cutting machines with a vacuum hold-down system using an overlay sheet for retaining the flexible materials on a cutting surface.

2. Description of the Related Art

Fabricating flexible products from web material includes a number of steps and utilizes complicated machinery. First, the web material is spread on a spreading table by a spreading machine. The material is typically spread one layer at a time to form a stack or a layup having a certain width and height. The stack is then moved to a cutter table and held in place with a vacuum hold-down system. A conventional cutter table extends in a lateral or Y-axis direction and a longitudinal or X-axis direction and has a permeable bristle surface. A cutter head is typically movably attached to a cutter beam with the cutter beam being movable along the cutter table in the X-axis direction and with the cutter head being movable with respect to the cutter beam in the Y-axis direction.

Once the layup is moved to the cutter table, parts are cut by the cutter head according to the desired the shapes of the cut parts. The cut parts can have either the same or different shapes. However, the individual parts in each layer will have the same shape as the part in the layer above or below. After the material has been cut, the layup of material must be evacuated from the cutting machine. The cut parts are then sewn together into a finished product at a later time.

In the past, various arrangements have been provided for paying out one or more air-impermeable overlay sheets as the cutter moves in cutting relation to a layup, for example to cover holes or kerfs formed in the layup by the cutting operation. One such apparatus designed to minimize leakage and loss of vacuum through cut sheet material is shown in U.S. Pat. No. 3,742,802 to Maerz, assigned to the assignee of the present disclosure.

A problem associated with the transfer of material from the discharge end of a conveyor bed onto a take-off table surface is that the overlay sheet material, in particular a single limp ply of such material, often bunches up as it reaches the take-off table. This may require manual intervention to maintain a continuous workflow.

BRIEF SUMMARY OF THE DISCLOSURE

Accordingly, it is an object of the present disclosure to provide an apparatus for handling overlay sheet material on a cutting apparatus including a conveyor for moving work material in a longitudinal direction and a support for positioning a tensioner frame adjacent the conveyor. A tensioner frame, attached to the support, has a nip wheel and a drive for rotating the nip wheel with a tangential speed in excess of the longitudinal conveyor speed. The nip wheel engages the overlay sheet material applying a tension thereto in the same longitudinal direction as the conveyor.

In keeping with the foregoing object, a more specific object of the disclosure is to provide a drive that includes an electric motor operatively connected to the nip wheel.

Yet a further object of the present disclosure is to provide a drive that includes a drive wheel operatively connected to the nip wheel.

Other objects and advantages of the present disclosure will become apparent from the following disclosure and the appended claims.

DETAILED DESCRIPTION OF THE DISCLOSURE

Figure 7:
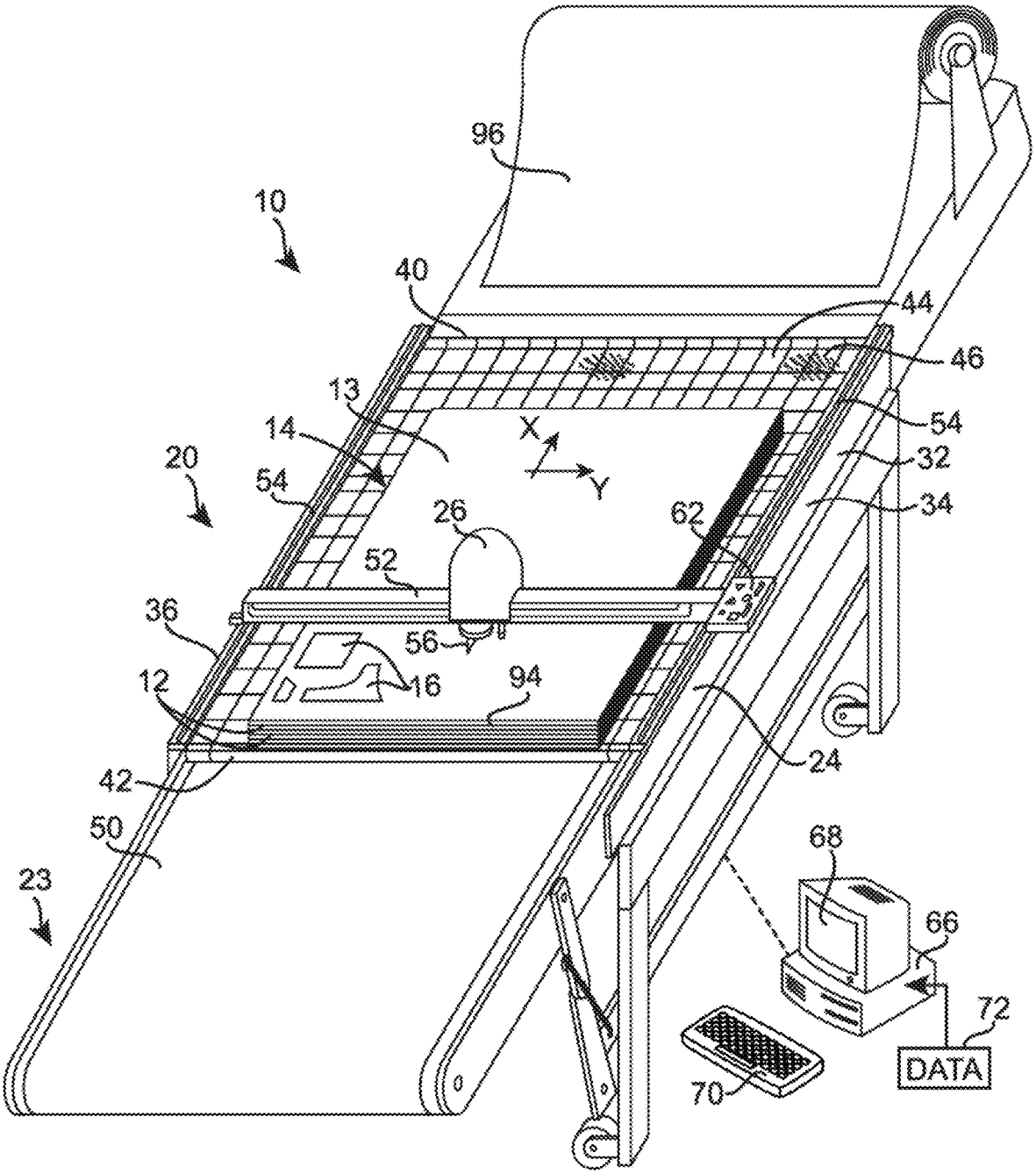
FIG. 7 (PRIOR ART)
FIG. 7 is a perspective view showing a cutting machine in which the present disclosure may be embodied.

Referring to FIG. 7, an apparatus 10 is shown for cutting a single ply or multiple plies 12 of limp material 13, referred to as a layup 14, into individual parts 16 of predetermined size and shape includes a cutting apparatus 20 and a take-off table 23. The cutting apparatus 20 includes a cutter table 24 for supporting the layup 14 and a cutter head 26 movable with respect to the cutter table 24.

The cutter table 24 includes a frame 32 and extends in a lateral, or Y-coordinate, direction from a console side 34 to a remote side 36 and in a longitudinal, or X-coordinate, direction from a take-on end 40 to a take-off end 42. The cutter table includes a conveyor 44 with a permeable bristle surface 46 that advances the layup 14 in the X-coordinate direction.

A cutter beam 52 supports the cutter head 26 and is movable in the X-coordinate direction along a pair of guide rails 54 secured to the cutter frame 32. The cutter beam also supports the camera 30 mounted on the other side of the beam 52 to avoid interference with the cutter head 26. The cutter head 26, which cuts the layup 14, and the camera 30, which scans the upper ply 12, move in the lateral or Y-coordinate direction across the cutter beam 52. A cutter tool 56 is supported within the cutter head 26.

The cutting apparatus 20 also includes an operator control panel 62 formed substantially integrally with the beam 52 and including a plurality of function buttons. The cutting apparatus 20 also includes a computer 66 with a monitor 68 and a keyboard 70 for controlling various cutting operations. The computer 66 includes data 72 such as cut data and matching data.

A roll of thin air-impermeable overlay material 96 is disposed substantially adjacent to the take-on end 40 of the cutter table 24 of the cutter apparatus 20. A layer of the thin overlay material 96 is spread over the air-permeable layup 14 for facilitating vacuum hold-down of the layup 14 during cutting operations.

A take-off table 23 is disposed at the take-off end 42 of the cutter table 24 for accommodating cut parts 16 subsequent to the cutting operation. The take-off table 23 includes a conveyor 50 that clears the material advanced from the cutter table 24.

In accordance with the disclosure, an overlay material tensioner is provided adjacent the take-off end 42 of cutter table 24 for maintaining tension on the overlay material as it comes off of cutter table 24 onto take-off table 23. The overlay tensioner may be rotatably mounted on a pivot support rod 108 fixedly attached to the side of cutter table 24 and/or take-off table 23. Preferably, two overlay material tensioners are provided per cutting table, one on each side of take-off table 23.

Figure 1:
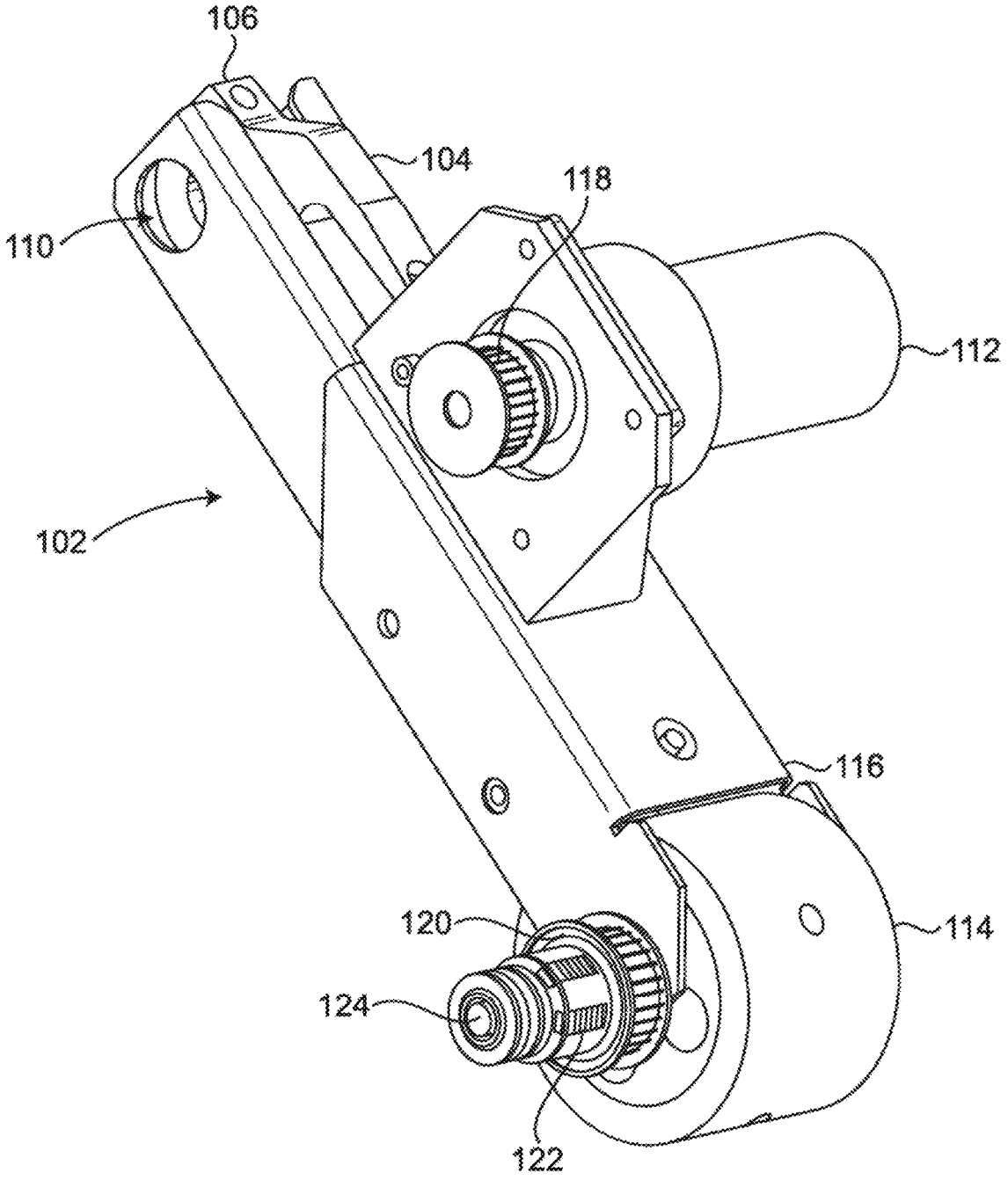
FIG. 1 is a perspective view of an overlay sheet tensioner in accordance with a first embodiment of the disclosure in an active position.

As shown in FIG. 1, a first embodiment of an overlay material tensioner 102 in accordance with the disclosure includes a tensioner frame 104 adapted at one end 106 to rotate about a pivot support rod 108 via hole 110, an electric motor 112 mounted on the tensioner frame 104 and a nip wheel 114 at the other end 116 of the tensioner frame 104 for engaging with the overlay material 96. The rotor shaft of the electric motor 112 is connected to a belt drive pulley 118 to transfer power via a drive belt 119 to a belt drive pulley 120 connected to the axle of the nip wheel 114. The belt drive pulley 120 of the nip wheel 114 may include a slip clutch 122 to control the amount of power transferred from the electric motor 112 to the nip wheel 114. It will be appreciated that the surface of the nip wheel 114 should have high coefficient of friction to insure firm engagement with the overlay material 96.

Figure 2:
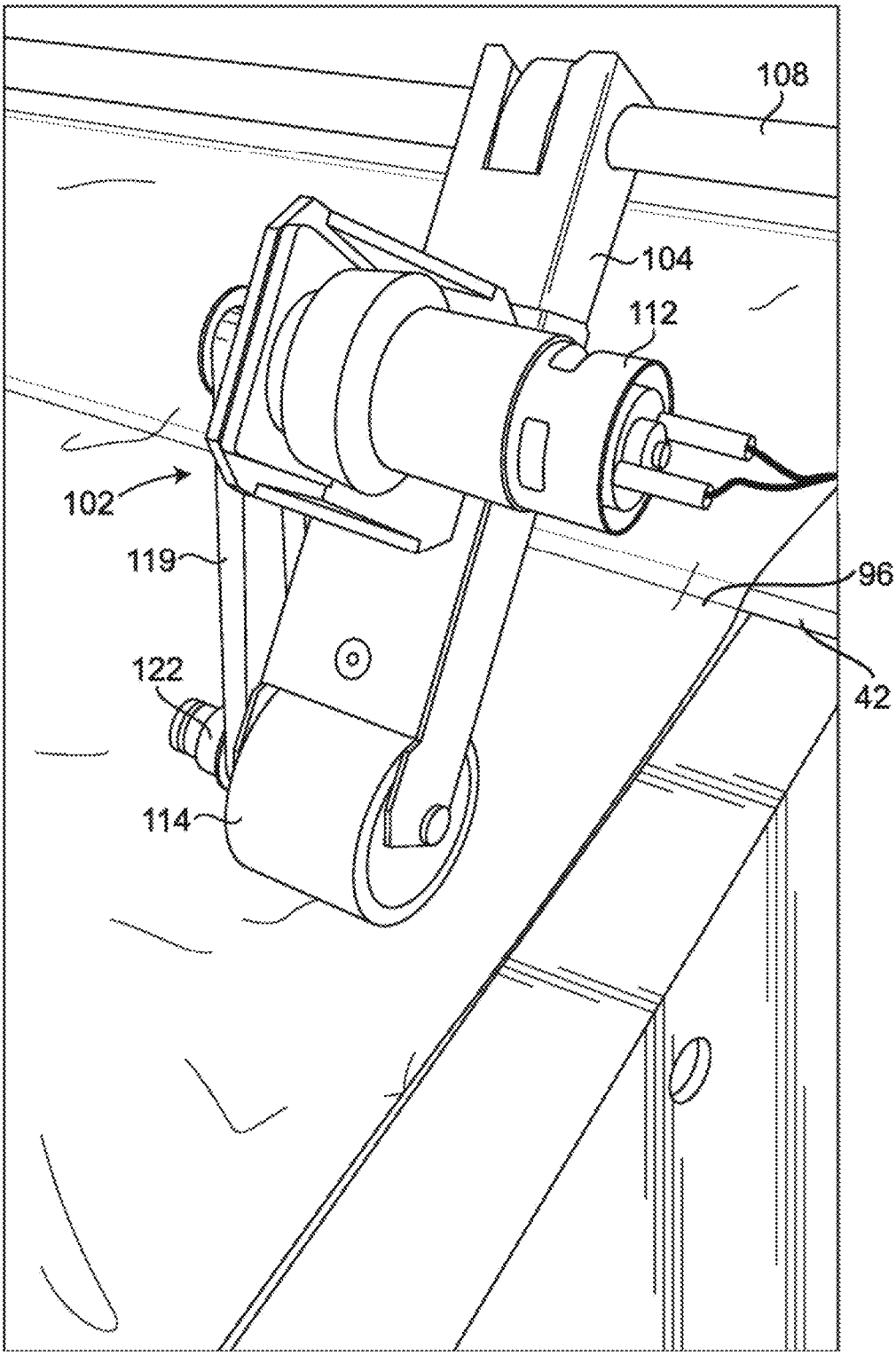
FIG. 2 is a perspective view of the overlay sheet tensioner of FIG. 1 in operation.

In a first active position, shown in FIG. 2, the overlay material tensioner 102 may engage the overlay material 96 between the nip wheel 114 and the take-off table 23 adjacent the take-off end 42 of cutter table 24. An enable switch (not shown) may be provided such that when the overlay material tensioner 102 is in the active down position the electric motor 112 may be energized by a conveyor signal of the cutting table 24.

It may be appreciated that by setting an appropriate electric motor speed, a tension is created in the overlay material 96 preventing gathering and bunching of the overlay material. The overlay material tensioner 102 applies tension to the overlay material 96 by trying to drive nip wheel 114 significantly faster than the take-off table conveyor 50. The slip clutch 122 allows the surface speed of the nip wheel 114 to match the surface speed of the take-off table conveyor 50, while generating an adjustable pull force (tension) on the overlay material 96. This tensioning action depends on there being a difference in the coefficients of friction between the nip wheel 114 to overlay material 96 and the overlay material 96 to take-off table conveyor 50.

The slip clutch torque should be set so that it creates as much tension on the overlay material 96 as possible without tearing the overlay material 96 or creating "excessive" stretching. Slip clutch torque may be adjusted manually by turning the adjustment knob 124 on the slip clutch 122. It will be appreciated that the amount of downward pressure/contact force exerted by nip wheel 114 is important. The higher the downward pressure/contact force, the greater the drive torque necessary and the greater the chance of damaging the overlay material 96 as the overlay material moves relative to the surface of the take-off table conveyor 50, and the less likely the overlay material 96 will actually be able to move across the surface of the take-off table conveyor 50 due to mechanical interlocking of the surfaces. It may be generally advantageous to maintain a relatively low contact force. However, if the contact force is too low, then the lateral tension force will be limited, since the tension force is a product of the contact force and the coefficient of friction between nip wheel 114 and the overlay material 96. Thus, these forces must be balanced in a manner known to those skilled in the art.

Preferably, the tangential speed of the nip wheel 114 should be approximately 20% faster than the surface speed of the take-off table conveyor 50. It may be appreciated that a benefit of a relatively large speed differential is minimization of the bunching/pleating of the overlay material. A higher speed differential, however, may negatively impact slip clutch life.

Figure 3:
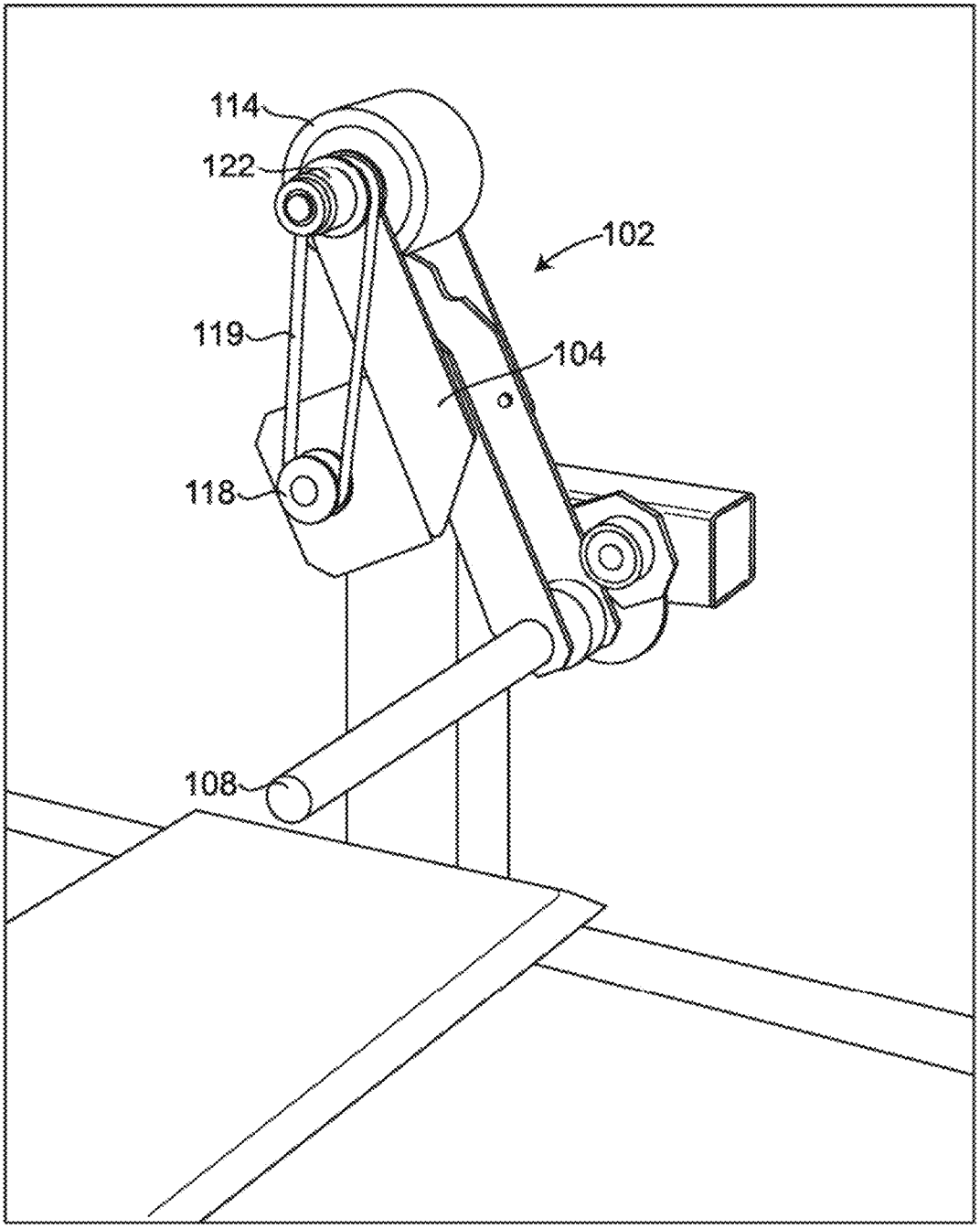
FIG. 3 is a perspective view of the overlay sheet tensioner of FIG. 1 in an inactive position.

In a second inactive position, shown in FIG. 3, the overlay tensioner 102 in accordance with the disclosure may be rotated about the pivot support rod 108 so that the overlay tensioner 102 is out of the way for operator operations on the cut material.

Figure 4:
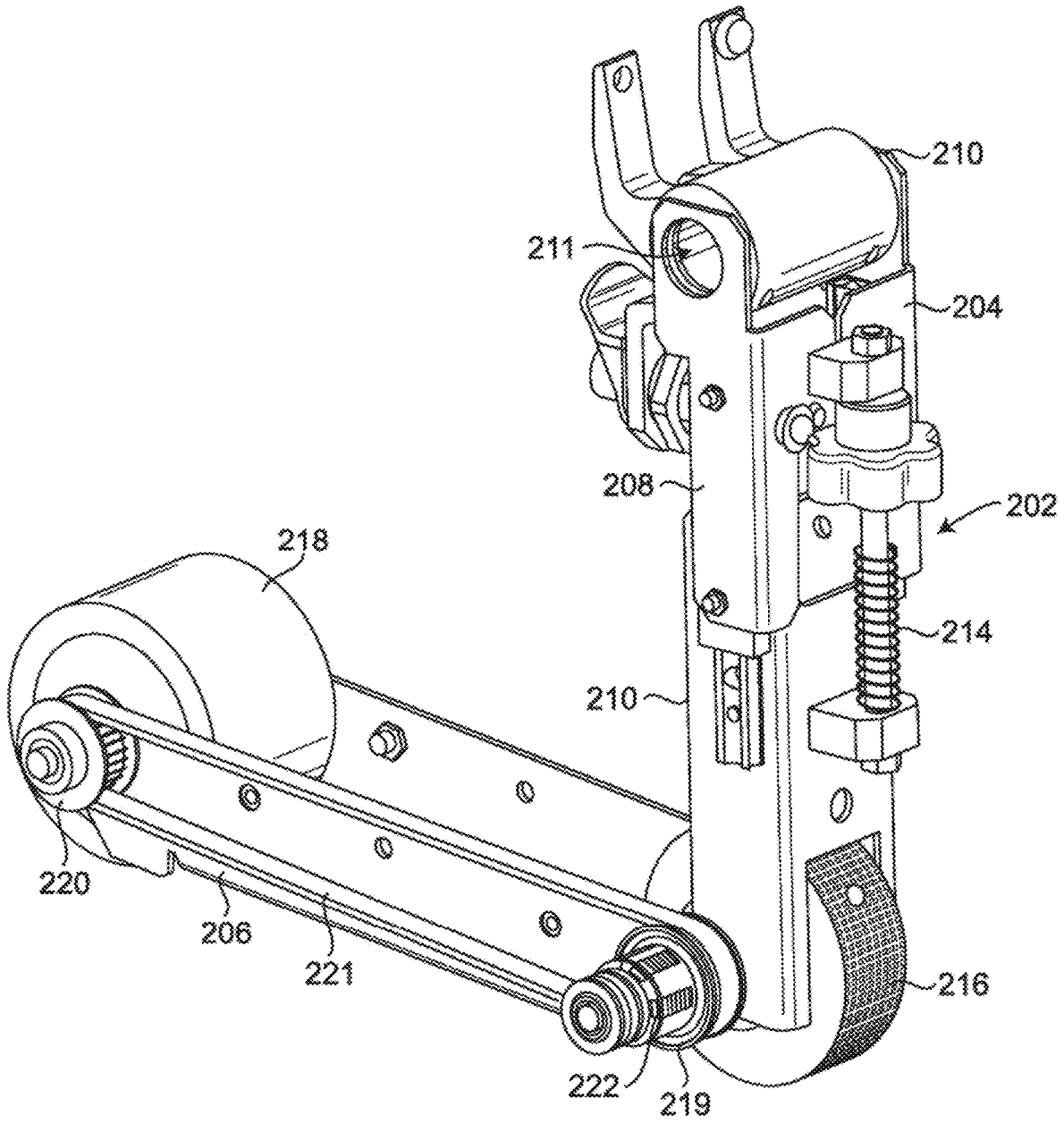
FIG. 4 is a perspective view of an overlay sheet tensioner in accordance with a second embodiment of the disclosure in an active position.

As shown in FIG. 4, a second embodiment 202 of an overlay material tensioner in accordance with the disclosure includes a first tensioner frame 204 and a second tensioner frame 206. The first tensioner frame 204 comprises an upper frame element 208 and a lower frame element 210. The upper frame element 208 is adapted at one end 210 to rotate about a pivot support rod 207 via hole 211 and the other end 212 is slidably connected to the lower frame element 210. The upper frame element 208 and the lower frame 210 element may be connected by a shock absorber 214.

The second tensioner frame 206 includes a knurled drive wheel 216 and nip wheel 218 rotatably mounted thereon. The axle of the knurled drive wheel 216 is connected to a belt drive pulley 219 to transfer power via a drive belt 221 to a belt drive pulley 220 connected to the nip wheel 218. The belt drive pulley 220 of the nip wheel 218 may include a slip clutch 222 to control the amount of power transferred from the knurled drive wheel 216 to the nip wheel 218. The knurled drive wheel 216 is sized relative to nip wheel 218 such that the tangential speed of the nip wheel is approximately 20% faster than that of the knurled drive wheel 216.

Figure 5:
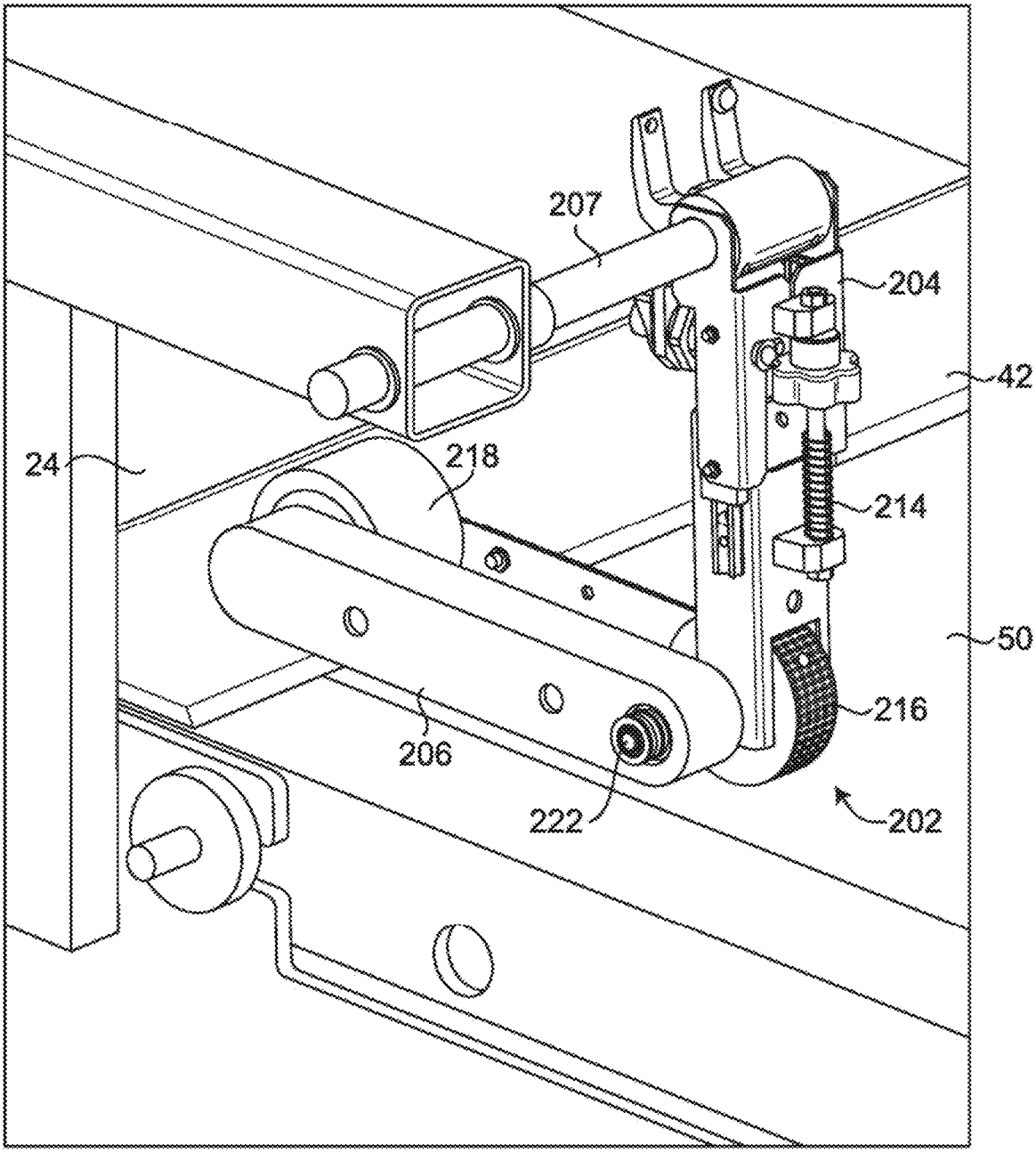
FIG. 5 is a perspective view of the overlay sheet tensioner of FIG. 4 mounted on a take-off table.

In a first active position, shown in FIG. 5, the knurled drive wheel 216 of the overlay material tensioner 202 engages moving take-off table conveyor 50 through the overlay material 96 thereby rotating the knurled drive wheel 216. The belt drive between the knurled drive wheel 216 and the nip wheel 218 rotates the nip wheel 218 adjacent the take-off end 42 of cutter table 24 thereby preventing gathering and bunching of the overlay material 96 as it exits from cutter table 24. The knurled drive wheel 216 requires enough contact force/downward pressure to engage the take-off table conveyor 50 without slipping; The contact force/downward pressure of nip wheel 218 are similar to the motor driven embodiment described above.

Figure 6:
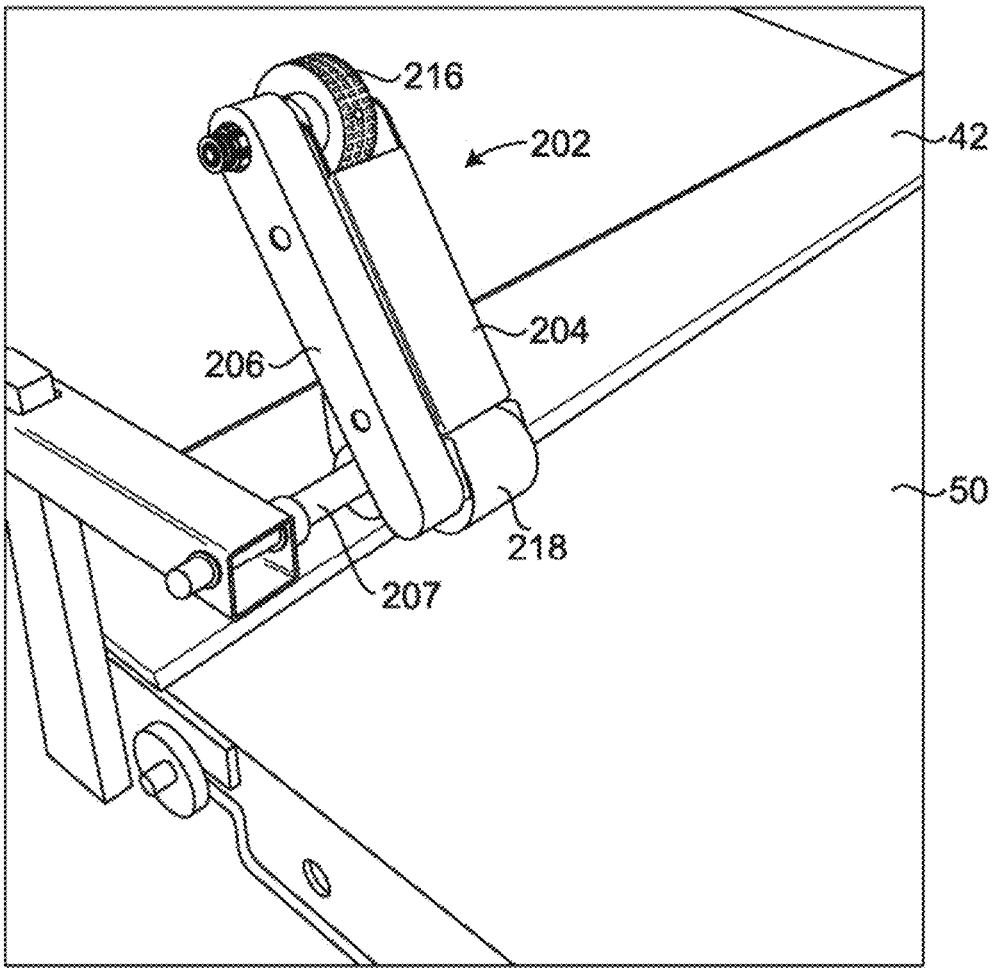
FIG. 6 is a perspective view of the overlay sheet tensioner of FIG. 4 in an inactive position.

In a second inactive position, shown in FIG. 6, the overlay tensioner 202 may be rotated about the pivot support rod 207 so that the overlay tensioner is out of the way for operator operations on the cut material.

While the present disclosure has been illustrated and described with respect to a particular embodiment thereof, it should be appreciated by those of ordinary skill in the art, that various modifications to this disclosure may be made without departing from the spirit and scope of the present disclosure.

What is claimed:

1. An overlay sheet tensioner apparatus for handling overlay sheet material on a cutting apparatus, comprising:

a conveyor for moving work material in a longitudinal direction in the cutting apparatus at a longitudinal conveyor speed, wherein the overlay sheet material is on the work material when on the cutting apparatus and cut with the work material;

a support adjacent the conveyor;

a tensioner frame attached to the support;

a nip wheel rotatably attached to the tensioner frame; and a drive attached to the tensioner frame for rotating the nip wheel with a tangential speed in excess of the longitudinal conveyor speed;

wherein the nip wheel frictionally engages the overlay sheet material applying a tension thereto in the longitudinal direction that the conveyor moves the work material to minimize bunching of the overlay sheet material as the overlay sheet material moves in the longitudinal direction.

2. The overlay sheet tensioner apparatus for handling overlay sheet material on a cutting apparatus in accordance with claim 1, wherein the drive further comprises an electric motor operatively connected to the nip wheel.

3. The overlay sheet tensioner apparatus for handling overlay sheet material on a cutting apparatus in accordance with claim 1, wherein the drive further comprises a drive wheel operatively connected to the nip wheel.

4. The overlay sheet tensioner apparatus for handling overlay sheet material on a cutting apparatus in accordance with claim 1, further comprising a slip clutch on the nip wheel.

5. The overlay sheet tensioner apparatus for handling overlay sheet material on a cutting apparatus in accordance with claim 1, wherein the support includes a bar and the tensioner frame forms a hole for receiving the bar so that the support provides for the tensioner apparatus to move between a first active position and a second inactive position by rotating the tensioner frame about the bar.

6. The overlay sheet tensioner apparatus for handling overlay sheet material on a cutting apparatus in accordance with claim 1, wherein the tangential speed of the nip wheel is approximately 20% faster than the longitudinal conveyor speed.

7. The overlay sheet tensioner apparatus for handling overlay sheet material on a cutting apparatus in accordance with claim 1, further comprising:

a second tensioner frame attached to the support;

a second nip wheel rotatably attached to the second tensioner frame; and a second drive attached to the second tensioner frame for rotating the second nip wheel with a second tangential speed in excess of the longitudinal conveyor speed;

wherein the second nip wheel frictionally engages the overlay sheet material applying a second tension thereto in the longitudinal direction that the conveyor moves the work material to minimize bunching of the overlay sheet material as the overlay sheet material moves in the longitudinal direction.

8. The overlay sheet tensioner apparatus for handling overlay sheet material on a cutting apparatus in accordance with claim 1, wherein the tensioner frame and the second tensioner frame are mounted on each side of the cutting apparatus.

9. A method for handling overlay sheet material on a cutting apparatus, comprising:

moving the overlay sheet material in a longitudinal direction on a conveyor of the cutting apparatus;

engaging the overlay sheet material with a nip wheel rotatably attached to a support adjacent the conveyor; and applying tension to the overlay sheet material in the same longitudinal direction as the conveyor by rotating the nip wheel with a drive having a tangential speed in excess of the longitudinal conveyor speed to minimize bunching of the overlay sheet material.

10. The method for handling overlay sheet material on a cutting apparatus in accordance with claim 9, wherein rotating the nip wheel with the drive further comprises using an electric motor operatively connected to the nip wheel.

11. The method for handling overlay sheet material on a cutting apparatus in accordance with claim 9, wherein rotating the nip wheel with the drive further comprises using a drive wheel operatively connected to the nip wheel.

12. The method for handling overlay sheet material on a cutting apparatus in accordance with claim 9, wherein rotating the nip wheel with the drive further comprises using a slip clutch on the nip wheel.

13. The method for handling overlay sheet material on a cutting apparatus in accordance with claim 9, wherein engaging the overlay sheet material with a nip wheel rotatably attached to a support further comprises selectively moving the nip wheel between a first active position touching the overlay sheet material and a second inactive position spaced from the overlay sheet material.

14. The method for handling overlay sheet material on a cutting apparatus in accordance with claim 9, comprising rotating the nip wheel at a tangential speed 20% faster than the longitudinal conveyor speed.

15. The method for handling overlay sheet material on a cutting apparatus in accordance with claim 9, further including a shock absorber coupled to the nip wheel.

16. An overlay material tensioner comprising:

a tensioner frame having a nip wheel with a high coefficient of friction surface to only press an overlay material moving longitudinally along a cutting table by a conveyor; and a motor configured to rotate the nip wheel faster than the conveyor to create tension on the overlay material to prevent bunching of the overlay material.

17. The overlay material tensioner of claim 16, wherein the tension is based on a difference in coefficients of friction between the nip wheel and the overlay material as compared to the conveyor and the overlay material.

18. The overlay material tensioner of claim 16, further comprising an enable switch so that when the tensioner frame is in an active down position, the motor is energized by a conveyor active signal of the cutting table.

19. The overlay material tensioner of claim 16, wherein a downward contact force of the nip wheel on the overlay material and the high coefficient of friction of the nip wheel are selected to prevent stretching and damage of the overlay material.

* * * * *